US010920504B1

(12) United States Patent
Jeseritz et al.

(10) Patent No.: US 10,920,504 B1
(45) Date of Patent: Feb. 16, 2021

(54) PIPE GRABBER

(71) Applicant: Hawker Equipment Solutions, LLC., Litchfield, MN (US)

(72) Inventors: Michael R. Jeseritz, Litchfield, MN (US); Ian F. Cockerline, Red Deer (CA)

( * ) Notice: Subject to any disclaimer, the term of this patent is extended or adjusted under 35 U.S.C. 154(b) by 0 days.

(21) Appl. No.: 16/518,978

(22) Filed: Jul. 22, 2019

Related U.S. Application Data

(60) Provisional application No. 62/701,412, filed on Jul. 20, 2018.

(51) Int. Cl.
*E21B 19/15* (2006.01)

(52) U.S. Cl.
CPC ..... *E21B 19/155* (2013.01)

(58) Field of Classification Search
CPC ..... E21B 19/155; E21B 19/14; E21B 19/15; E21B 19/16; E21B 19/163; E21B 19/20
USPC ..... 414/22.51–22.71; 294/118
See application file for complete search history.

(56) References Cited

U.S. PATENT DOCUMENTS

| | | | | |
|---|---|---|---|---|
| 495,716 | A | 4/1893 | Wilkinson | |
| 1,047,177 | A | 12/1912 | Cuenot et al. | |
| 2,577,929 | A | 12/1951 | Stiles | |
| 2,628,725 | A | 2/1953 | Stone | |
| 2,643,006 | A | 6/1953 | King | |
| 2,833,433 | A | 10/1953 | Paananen | |
| 2,903,294 | A | 12/1955 | Shook | |
| 2,880,881 | A | 4/1959 | Robishaw | |
| 2,958,430 | A | 11/1960 | Robishaw | |
| 3,071,405 | A | 1/1963 | Koehler | |
| 3,177,944 | A | 4/1965 | Knights | |
| 3,208,789 | A * | 9/1965 | Barry | B66C 1/64 294/110.1 |
| 3,212,593 | A | 10/1965 | Reischl | |
| 3,259,368 | A | 7/1966 | Warnke | |
| 3,280,920 | A | 10/1966 | Scott | |
| 3,322,456 | A | 5/1967 | Strakhal et al. | |
| 3,539,024 | A | 11/1970 | Irons et al. | |
| 3,559,821 | A | 2/1971 | James | |
| 3,616,941 | A | 11/1971 | Walling | |
| 3,633,771 | A | 1/1972 | Woolslayer et al. | |

(Continued)

FOREIGN PATENT DOCUMENTS

| | | | |
|---|---|---|---|
| CA | 2224638 | A1 | 6/1999 |
| CA | 2431213 | C | 10/2004 |

(Continued)

*Primary Examiner* — Lynn E Schwenning
(74) *Attorney, Agent, or Firm* — Albert W. Watkins

(57) ABSTRACT

A pipe grabber is readily installed onto a pipe handler used to elevate large and heavy sections of pipe to and from a drilling platform. The pipe grabber has a pair of upper link arms pivotal about an upper cylinder pin, a pair of lower link arms pivotal about a lower cylinder pin, a pair of link pins coupling individual ones of the pair of upper link arms to individual ones of the pair of lower link arms, and a hydraulic cylinder affixed between the upper and lower cylinder pins. The pipe grabber captures a pipe within the pipe supporting trough when the cylinder is extended, and the upper link arms are configured to retract within a pipe grabber housing beneath the pipe supporting trough when the cylinder is retracted. A pair of hooks protrude from a housing side wall to suspend the pipe grabber from a pipe handler.

17 Claims, 2 Drawing Sheets

(56) References Cited

U.S. PATENT DOCUMENTS

| | | | | |
|---|---|---|---|---|
| 3,706,347 | A | 12/1972 | Brown | |
| 3,716,149 | A | 2/1973 | Scaggs | |
| 3,734,208 | A | 5/1973 | Otto | |
| 3,734,210 | A | 5/1973 | Wilderman | |
| 3,743,078 | A | 7/1973 | Pittoreau | |
| 3,750,804 | A | 8/1973 | Lemelson | |
| 3,774,780 | A | 11/1973 | Buffington | |
| 3,792,783 | A | 2/1974 | Brown | |
| 3,810,553 | A | 5/1974 | Crocker et al. | |
| 3,860,122 | A | 1/1975 | Cernosek | |
| 3,916,500 | A | 11/1975 | Brown | |
| 3,937,334 | A | 2/1976 | Bleyl et al. | |
| 3,983,949 | A | 10/1976 | Pozniko | |
| 3,991,887 | A | 11/1976 | Trout | |
| 4,023,449 | A | 5/1977 | Boyadjieff | |
| 4,030,625 | A * | 6/1977 | Koehnen | B66C 1/585 414/739 |
| 4,040,524 | A | 8/1977 | Lamb et al. | |
| 4,053,063 | A | 10/1977 | Harper, Jr. | |
| 4,081,087 | A | 3/1978 | Freeman, Sr. | |
| 4,082,193 | A | 4/1978 | Teague | |
| 4,134,501 | A | 1/1979 | Tune | |
| 4,140,227 | A | 2/1979 | Beck | |
| 4,235,566 | A | 11/1980 | Beeman et al. | |
| 4,255,069 | A | 3/1981 | Yielding | |
| 4,304,433 | A * | 12/1981 | Langowski | E21B 19/14 294/106 |
| 4,368,602 | A | 1/1983 | Manten | |
| 4,371,302 | A | 2/1983 | Frias et al. | |
| 4,379,676 | A | 4/1983 | Frias | |
| 4,380,297 | A | 4/1983 | Frias | |
| 4,382,591 | A | 5/1983 | Minnis et al. | |
| 4,382,738 | A | 5/1983 | Frias | |
| 4,396,883 | A | 8/1983 | Holloway et al. | |
| 4,403,898 | A | 9/1983 | Thompson | |
| 4,426,182 | A | 1/1984 | Frias et al. | |
| 4,438,984 | A | 3/1984 | Leppala | |
| 4,439,091 | A | 3/1984 | Frias | |
| 4,453,872 | A | 6/1984 | Frias et al. | |
| 4,470,740 | A | 9/1984 | Frias | |
| 4,474,520 | A | 10/1984 | Buckner et al. | |
| 4,484,775 | A | 11/1984 | Norkus | |
| 4,492,502 | A | 1/1985 | Delano | |
| 4,494,899 | A | 1/1985 | Hoang et al. | |
| 4,684,314 | A | 8/1987 | Luth | |
| 4,718,805 | A * | 1/1988 | Becker | E21B 19/155 175/85 |
| 4,815,712 | A | 3/1989 | Kawada | |
| 5,012,898 | A | 5/1991 | Tsymberov | |
| 5,190,122 | A | 3/1993 | Fletcher et al. | |
| 5,320,208 | A | 6/1994 | Mason | |
| 5,481,769 | A | 1/1996 | Schneider | |
| 5,915,882 | A | 6/1999 | Darwiche et al. | |
| 6,079,925 | A | 6/2000 | Morgan et al. | |
| 6,085,852 | A | 7/2000 | Sparks et al. | |
| 6,543,551 | B1 | 4/2003 | Sparks et al. | |
| 6,705,414 | B2 | 3/2004 | Simpson et al. | |
| 6,899,510 | B2 | 5/2005 | Morelli et al. | |
| 7,021,880 | B2 | 4/2006 | Morelli et al. | |
| 7,163,367 | B2 | 1/2007 | Handley | |
| 7,473,065 | B2 | 1/2009 | Wells | |
| 7,635,249 | B2 | 12/2009 | Guidroz | |
| 7,665,944 | B2 | 2/2010 | Guidroz | |
| 7,744,327 | B2 | 6/2010 | Lops et al. | |
| 7,992,646 | B2 | 8/2011 | Wright et al. | |
| 8,052,368 | B2 | 11/2011 | Littlewood et al. | |
| 8,840,352 | B2 | 9/2014 | Taggart et al. | |
| 8,899,907 | B2 * | 12/2014 | Flusche | B65G 47/82 414/745.9 |
| 9,388,647 | B2 | 7/2016 | Dahmes et al. | |
| 9,551,193 | B2 | 1/2017 | Cheeseman et al. | |
| 9,845,646 | B2 | 12/2017 | Dahmes et al. | |
| 2004/0136813 | A1 | 7/2004 | Pietras | |
| 2005/0079044 | A1 | 4/2005 | Handley | |
| 2006/0104746 | A1 | 5/2006 | Thompson | |
| 2008/0263990 | A1 | 10/2008 | Morelli et al. | |
| 2009/0272235 | A1 | 11/2009 | Berry | |
| 2010/0187740 | A1 * | 7/2010 | Orgeron | B25B 5/061 269/218 |
| 2014/0238745 | A1 | 8/2014 | Dahmes et al. | |
| 2014/0356120 | A1 | 12/2014 | Seed | |
| 2015/0008038 | A1 | 1/2015 | Folk | |
| 2016/0319612 | A1 | 11/2016 | Dahmes et al. | |
| 2017/0328146 | A1 | 11/2017 | Meuth et al. | |
| 2018/0119501 | A1 * | 5/2018 | Kennemer | E21B 19/155 |

FOREIGN PATENT DOCUMENTS

| | | |
|---|---|---|
| WO | WO 2014172690 A2 | 10/2014 |
| WO | WO 2017196467 A1 | 11/2017 |

* cited by examiner

FIG. 1
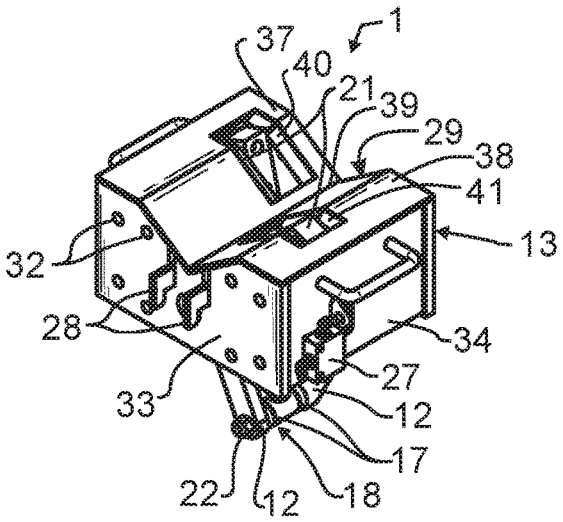
FIG. 2
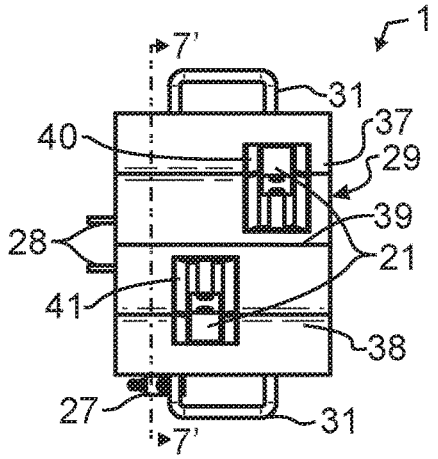
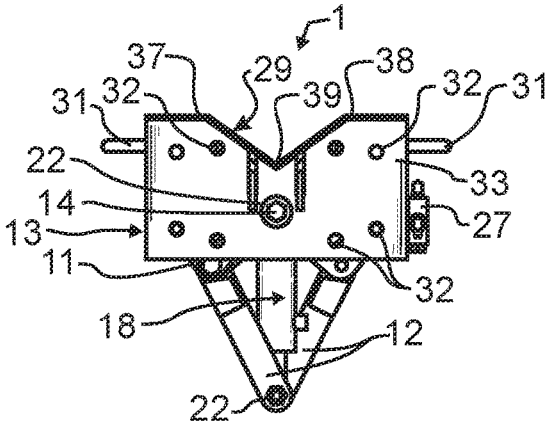
FIG. 3
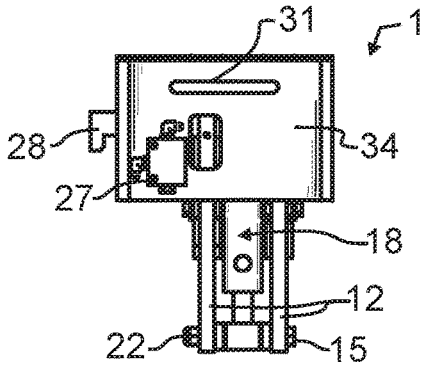
FIG. 4
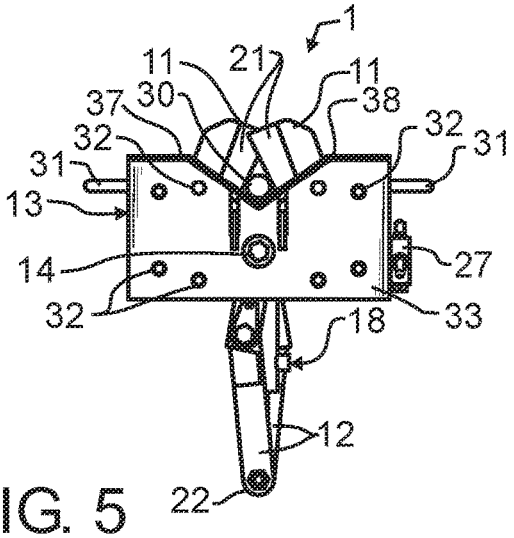
FIG. 5

PIPE GRABBER

CROSS REFERENCE TO RELATED APPLICATIONS

The present application claims the benefit of U.S. provisional patent application 62/701,412 filed Jul. 20, 2018 of like title and inventorship, the teachings and entire contents which are incorporated herein by reference.

BACKGROUND OF THE INVENTION

1. Field of the Invention

This invention pertains generally to material or article handling, and more particularly to a pipe handler such as might commonly be used in the oil drilling and rigging industry and in the well servicing industry to assist with the handling of very large and heavy pipes that are regularly raised to and lowered from an elevated drilling platform. More particularly, the present invention pertains to a pipe grabber that is used to securely retain a pipe within the pipe handler when so required or desired.

2. Description of the Related Art

In the oil drilling and rigging industry, drilling platforms commonly referred to as derricks are assembled above the earth. These derricks facilitate the drilling and installation of wells. The platform or work floor typically may be elevated many feet above the ground.

Drill strings of very large and heavy pipes are assembled or disassembled on the derrick. For exemplary and non-limiting purposes, these pipes may be stored horizontally on or near the ground adjacent to the derrick. This means that these very large and heavy pipes must be re-oriented from horizontal to more nearly vertical orientation, and raised from near ground level to several tens of feet into the air. Consequently, the handling of these large and heavy pipes is not suited to manual labor, and instead requires mechanical assistance.

Pipe handlers are commonly used to assist with the regular raising and lowering of these very large and heavy pipes to and from an elevated drilling platform. A large number of patents are exemplary of this technology, and provide the background for the basic features, while also contrasting with the novel features of the present invention. These U.S. patents, the contents and teachings which are incorporated herein by reference, include: U.S. Pat. No. 2,643,006 by King, entitled "Automatic pipe handler," that illustrates an early automatic pipe handler, and describes a bumper or stop having a resilient portion in the form of a rubber or spring against which the drill pipe may abut, that prevents a pipe section from sliding down the dolly. U.S. Pat. No. 3,792,783, entitled "Pipe Handling System" and U.S. Pat. No. 3,916,500 entitled "Pipe handling apparatus", each by Cicero C. Brown, the contents and teachings which are incorporated herein by reference, describe another early automatic pipe handler having an endless cable or chain driving a lug to elevate or lower a pipe in a trough to push the pipe toward the derrick. U.S. Pat. No. 4,386,883 by Hogan et al, entitled "Materials lifting apparatus" and U.S. Pat. No. 4,494,899 by Hoang et al, entitled "Pipe trough for transporting pipe between upper and lower positions", the contents and teachings which are incorporated herein by reference, each describe automatic pipe handlers with kickers to assist with the loading and unloading of pipes. Hogan refers to these kickers as pipe ejecting assemblies that eject the pipe from the carriage using an arm and a ram, and Hoang et al refers to these as unloading arms for ejecting the pipe from the trough. Hoang et al also describe pipe loading arms to assist with loading pipe into the trough. U.S. Pat. No. 4,235,566 by Beeman et al, entitled "Pipe-conveying catwalk" and U.S. Pat. No. 4,439,091 by Frias, entitled "Pipe feeding system", the contents and teachings which are incorporated herein by reference, each illustrate carriages that move along a trough. The teachings and content of U.S. Pat. No. 3,559,821 by James, entitled "Drill Pipe Handling Apparatus" and which illustrates another drill pipe handling apparatus, is additionally incorporated herein by reference.

Additional U.S. patents illustrating various kicker constructions, the teachings and contents which are incorporated herein by reference, include: U.S. Pat. No. 4,140,227 by Beck, entitled "Cable way apparatus for transporting pipe"; and U.S. Pat. No. 4,403,898 by Thompson, entitled "Pipe pick-up and laydown machine". Additional patents showing rigid pipe handler structures, the teachings and contents which are incorporated herein by reference, include: U.S. Pat. No. 2,880,881 by Robishaw, entitled "Unitized pipe rack"; U.S. Pat. No. 2,958,430 by Robishaw, entitled "Pipe rack and lay-down trough"; U.S. Pat. No. 4,684,314 by Luth, entitled "Pipe handling apparatus"; U.S. Pat. No. 6,079,925 by Morgan et al, entitled "Method and apparatus for lifting oilfield goods to a derrick floor"; U.S. Pat. No. 7,635,249 by Guidroz, entitled "Pipe pick-up and laydown apparatus"; U.S. Pat. No. 7,665,944 by Guidroz, entitled "Pipe pick-up and laydown apparatus and method"; U.S. Pat. No. 7,992,646 by Wright et al, entitled "Horizontal offline stand building system"; and U.S. Pat. No. 8,052,368 by Littlewood et al, entitled "Catwalk for a drilling rig".

Other relevant patents and published applications, the teachings and contents which are incorporated herein by reference, include: U.S. Pat. No. 6,899,510 by Morelli et al, entitled "Pipe handling system for presenting sections of pipe to a derrick work floor having a pipe ejection assembly"; U.S. Pat. No. 7,021,880 by Morelli et al, entitled "Pipe handling apparatus for presenting sections of pipe to a derrick work floor having a high-speed carriage assembly"; U.S. Pat. No. 7,163,367 by Handley, entitled "Multi-position height adjustment system for a pipe handling apparatus"; and 2008/0263990 by Morelli et al, entitled "Skidding system for a catwalk".

In addition to the aforementioned patents and published patent applications, the present applicant also commonly owns U.S. Pat. Nos. 9,388,647 and 9,845,646, the teachings and contents which are incorporated herein by reference. These patents illustrate novel height adjustment assemblies to set the maximum height that the skidway or trough, also sometimes referred to as the boom, will reach when the hydraulic lift cylinder is fully extended.

From these foregoing patents, the basic structure of a pipe handler and the function thereof will be well understood.

In some cases, an operator may desire to securely hold a pipe within the trough of a pipe handler. For exemplary and non-limiting purpose, when the handler trough is raised to an incline, a pipe clamp will ensure that the pipe is held and cannot move within the trough. Then, an operator will take further action. Again for exemplary and non-limiting purpose, such action might include affixing other apparatus to the pipe for further movement and use separate from the pipe handler. As is apparent, the pipe has been raised to the drilling platform for use as a drill pipe, well casing, or other purpose. To be useful, the pipe must be transferred from the pipe handler to the drilling platform. This transfer will most preferably be achieved in an efficient manner and without concern about the pipe being accidently dislodged or dropped from the trough. In consideration of the enormous weight of drilling rig pipes, safe handling and operations are highly valued.

There are many other circumstances and situations that can benefit from grabbing and securing the pipe within the trough. For exemplary and non-limiting purpose, when a first pipe section has been raised in the trough to the uppermost position, the carriage that moves the pipe along the trough in some designs may be efficiently returned to the lowermost position and the next pipe section loaded, if the first pipe section is secured adjacent the uppermost end of the trough.

In consideration of the foregoing, it is desirable to provide a clamp or grabber that may be activated to secure the pipe. One approach is to provide two independent pipe gripping jaws, each operate by a separate hydraulic cylinder. Exemplary U.S. patents and published applications, the teachings which are incorporated herein by reference, include: U.S. Pat. No. 3,734,210 by Wilderman, entitled "Carrier mounted drilling unit"; U.S. Pat. No. 3,860,122 by Cernosek, entitled "Positioning apparatus"; U.S. Pat. No. 4,382,591 by Minnis et al, entitled "Clamping means for trough of pipe handling apparatus"; U.S. Pat. No. 9,551,193 by Cheeseman et al, entitled "Drill pipe handling apparatus having improved pipe gripping mechanism"; and 2014/0356120 by Seed, entitled "Rod Loader Attachment".

While illustrating a very functional pipe grabber having a number of benefits, there remain disadvantages that are also associated with these apparatus. The use of two independent hydraulic cylinders, one to operate each jaw, leads to several deficiencies. While such cylinders tend to be very reliable, in the event of a partial malfunction of one, the apparatus does not safely secure the pipe, and yet the operator may not be aware of the lack of adequate holding force in the partially malfunctioning cylinder. Further, the two independent cylinders may not operate synchronously, particularly with wear and build-up of debris over time, meaning one jaw may close ahead of the other. In such case, the pipe may be "scrubbed" back and forth during the effecting of the gripping, which can either lead to a complete failure to secure the pipe, or alternatively lead to wear or damage of the trough over time even when the pipe is ultimately adequately secured.

U.S. Pat. No. 3,322,456 by Strakhal et al, entitled "Pipe-gripping device used for pulling and running operations in the boring of wells," illustrates an apparatus operated by a single cylinder, the teachings which are incorporated herein by reference. This device lacks any mechanism to ensure centering and even pressure is initially applied during the gripping sequence, a deficiency which may not be of consequence when simply holding a pipe during threading and unthreading as described in the patent, but which as noted above will result in undesirable shifting and scrubbing motion when used with a pipe trough.

Another limitation of many of the prior art grabbers is a risk of potential interference between the inactive pipe grabber and other equipment or processes. Each of the aforementioned apparatus stick out or up from the trough, meaning an operator on the drilling rig must carefully maneuver the pipe being transferred to avoid damaging and very dangerous impact between the pipe and the grabber.

Additional U.S. and Foreign patents and published applications of varying relevance, the relevant teachings and contents which are incorporated herein by reference, include: U.S. Pat. No. 1,047,177 by Cuenot et al, entitled "Milling Machine"; U.S. Pat. No. 2,833,433 by Paananen, entitled "Apparatus for Loading wood logs"; U.S. Pat. No. 2,903,294 by Shook, entitled "Grapple for material handling and earth moving apparatus"; U.S. Pat. No. 3,071,405 by Koehler, entitled "Tong assembly"; U.S. Pat. No. 3,983,949 by Pozniko, entitled "Auger section positioning means"; U.S. Pat. No. 4,023,449 by Boyadjieff, entitled "Tool for connecting and disconnecting well pipe"; U.S. Pat. No. 4,438,984 by Leppaelae, entitled "Drill steel guiding and centralizing mechanism"; U.S. Pat. No. 4,484,775 by Norkus, entitled "Adjustable smooth action linkage gripper mechanism"; U.S. Pat. No. 6,543,551 by Sparks et al, entitled "Pipe handling device"; and U.S. Pat. No. 8,840,352 by Taggart et al, entitled "Apparatus and method for handling pipe".

In addition to the foregoing patents, Webster's New Universal Unabridged Dictionary, Second Edition copyright 1983, is incorporated herein by reference in entirety for the definitions of words and terms used herein.

As may be apparent, in spite of the enormous advancements and substantial research and development that has been conducted, there still remains a need for an improved pipe grabber that may be used in association with a pipe handler.

SUMMARY OF THE INVENTION

In a first manifestation, the invention is, in combination, a pipe handler and pipe grabber. The pipe handler has a boom with a pipe supporting trough. The pipe grabber has a pipe grabber housing having a pipe retaining trough and side walls extending from said pipe retaining trough. An upper cylinder pin and a lower cylinder pin are provided within the housing. A pair of upper link arms are pivotal about the upper cylinder pin. A pair of lower link arms are pivotal about the lower cylinder pin. A pair of link pins couple individual ones of the pair of upper link arms to individual ones of the pair of lower link arms. A hydraulic cylinder is affixed between the upper cylinder pin and lower cylinder pin. The pipe grabber is configured to capture a pipe within the pipe supporting trough when the hydraulic cylinder is extended; and the upper link arms are configured to retract within the pipe grabber housing when the hydraulic cylinder is retracted.

In a second manifestation, the invention is a pipe grabber. The pipe grabber has an upper cylinder pin; a lower cylinder pin; a pair of upper link arms pivotal about the upper cylinder pin; a pair of lower link arms pivotal about the lower cylinder pin; a pair of link pins coupling individual ones of the pair of upper link arms to individual ones of the pair of lower link arms; and a cylinder affixed between the upper cylinder pin and the lower cylinder pin. The cylinder is operative to pivot said pair of upper link arms distal to said upper cylinder pin closer together when said cylinder is extended.

In a third manifestation, the invention is a pipe grabber. The pipe grabber has a pipe retaining trough having a depression running longitudinally between first and second ridges. A first perforation passes through the first ridge. A second perforation passing through the second ridge. A first pivotal jaw is pivotal between a first active position passing through the first perforation and a second retracted position not passing through the first perforation. A second pivotal jaw is pivotal between a first active position passing through the second perforation and a second retracted position not passing through the second perforation. The first and second pivotal jaws are configured to capture a pipe within the pipe retaining trough when each are in the first active position, and are configured to retract from the pipe retaining trough when each are in the second retracted position.

OBJECTS OF THE INVENTION

Exemplary embodiments of the present invention solve inadequacies of the prior art by providing a pipe grabber uniquely configured for installation onto a pipe handler. The pipe handler has a boom with a pipe supporting trough. The pipe grabber has a pair of upper link arms pivotal about an upper cylinder pin, a pair of lower link arms pivotal about a lower cylinder pin, a pair of link pins coupling individual ones of the pair of upper link arms to individual ones of the pair of lower link arms, and a hydraulic cylinder affixed between said upper cylinder pin and lower cylinder pin. The pipe grabber is configured to capture a pipe within the pipe supporting trough when the hydraulic cylinder is extended, and the upper link arms are configured to retract within a pipe grabber housing beneath the pipe supporting trough when the hydraulic cylinder is retracted.

The present invention and the preferred and alternative embodiments have been developed with a number of objectives in mind. While not all of these objectives are found in every embodiment, these objectives nevertheless provide a sense of the general intent and the many possible benefits that are available from embodiments of the present invention.

A first object of the invention is to provide a pipe grabber that will safely and reliably hold a pipe within a pipe handler trough. A second object of the invention is to secure the pipe with even movement of the jaws, so as to avoid any scrubbing motion during activation. Another object of the present invention is to facilitate the selective attachment and removal of the pipe grabber, so that the pipe grabber may be affixed only when required by a particular drilling platform installation. Yet another object of the present invention is to ensure the handling of a pipe will proceed as it would without the pipe grabber being installed, and without any added risk or potential interference between the grabber and either the pipe or other machinery during use when the grabber is inactive. A further object of the invention is to ensure that the attachment, use, and maintenance of the pipe grabber is intuitive.

BRIEF DESCRIPTION OF THE DRAWINGS

The foregoing and other objects, advantages, and novel features of the present invention can be understood and appreciated by reference to the following detailed description of the invention, taken in conjunction with the accompanying drawings, in which:

FIGS. 1-4 illustrate a preferred embodiment pipe grabber designed in accord with the teachings of the present invention from isometric, top, front, and side views, respectively in a retracted or inoperative position.

FIG. 5 illustrates the preferred embodiment pipe grabber of FIGS. 1-4 from a front view in an extended or operative position in further combination with a pipe.

DESCRIPTION OF THE PREFERRED EMBODIMENT

Figure 6:
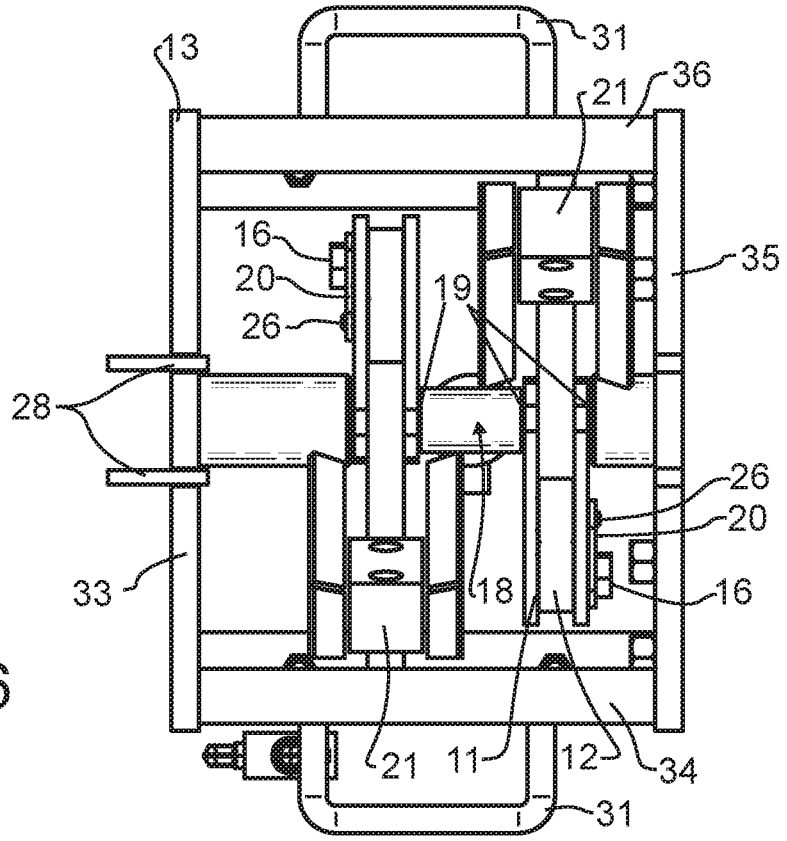
FIG. 6 illustrates the preferred embodiment pipe grabber of FIGS. 1-4 from a top view with the trough extension removed for viewing purposes, and in an retracted or inoperative position.

Manifested in the preferred embodiment, the present invention provides a pipe grabber 1 that may be selectively activated to securely hold a pipe within the trough of a pipe handler. In a preferred embodiment of the invention, pipe grabber 1 may be selectively activated to engage a pipe such as pipe 30 illustrated in FIG. 5, or may be fully retracted below the pipe trough such as illustrated in FIGS. 1-4, 6, and 7.

Preferred embodiment pipe grabber 1 is comprised of a pipe grabber box 13 which defines a housing or container for the remaining components. Preferred embodiment pipe grabber 1 may be lifted by an installer grasping with one hand on each respective handle 31. The installer will then engage a pair of L-shaped support hooks 28 in and hook on to the end of an existing pipe handler such as illustrated in the present applicant's commonly owned U.S. Pat. Nos. 9,388,647 and 9,845,646 incorporated by reference herein above. This temporarily supports preferred embodiment pipe grabber 1 from the end of the pipe handler boom. The bottom cover of pipe grabber box 13 will preferably be removed, and fasteners such as bolts are then passed through holes such as holes 32 in side wall 33 where they are then used to rigidly fasten preferred embodiment pipe grabber 1 to the pipe handler. The bottom cover of pipe grabber box 13 will then be reattached. While other techniques for securing preferred embodiment pipe grabber 1 to the pipe handler may be used, of which a plethora are known from the mechanical arts, the present technique is very much preferred owing to the rapid connect and disconnect, and the intuitive nature of the coupling and procedure presented herein.

As a result of this placement, trough extension 29 will most preferably align with and only slightly extend the pipe trough of the pipe handler. The selective attachment and removal of the pipe grabber enables the pipe grabber to be affixed only when required by a particular drilling platform installation, without altering other operation of the pipe handler.

Figure 7:
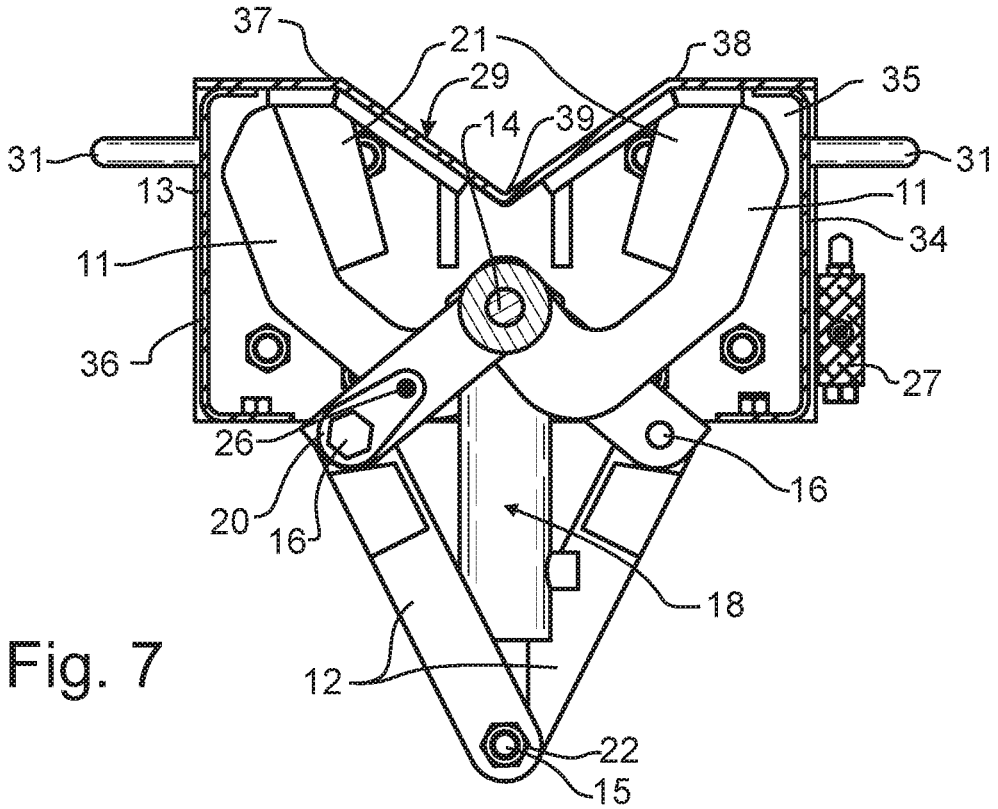
FIG. 7 illustrates the preferred embodiment pipe grabber of FIGS. 1-4 from sectional view taken along line 7' of FIG. 2.

An upper cylinder pin 14, visible in FIGS. 3, 5, and 7, extends longitudinally parallel with trough extension 29 and acts as a support and pivot for a pair of opposed upper link arms 11. While a cylinder pin is most preferred, and will work will the components described herein, other suitable mechanical apparatus that act as a support and pivot may be used in other embodiments.

Each individual one of the pair of opposed upper link arms 11 are pivotally coupled with an individual one of a pair of oppositely acting lower link arms 12 through one of the two link pins 16. Each one of link pins 16 may for exemplary and non-limiting purpose be securely affixed with a link pin retainer 20 and associated fastener 26, which might for exemplary purposes comprise a socket head cap screw. Link pin retainer 20 in the preferred embodiment is welded or otherwise more permanently affixed to link pin 16 after being fitted in place.

The benefit of using link pin retainer 20 in this particular location is that it permits keeping the pair of opposed upper link arms 11 as close together as possible, while also keeping them as close as possible to hydraulic cylinder 18. This reduces the amount of undesirable torque within the components of preferred embodiment pipe grabber 1 and a pipe 30 that is generated when closing upper link arms 11 about pipe 30.

If instead a standard pin, through bolt, nut or the like was provided on the opposite side of link pin 16, then more space would be required between upper link arms 11 and hydraulic cylinder 18, resulting in greater undesired torque. In addition, a bushing would then be required between upper link arms 11 and link pin 16. Since link pin retainer 20 is welded to link pin 16 in preferred embodiment pipe grabber 1, a bushing is only required between lower link arm 12 and link pin 16. Because a bushing is not required, upper link arms 11 in the vicinity of link pins 16 may also be relatively narrower, again reducing the undesirable generation of torque.

At the end of each lower link arm 12 distal to link pin 16, each link arm 12 is coupled pivotally to lower cylinder pin 15. Lower cylinder pin 15 may for exemplary and non-limiting purpose be secured in place using a locking nut 22, such as the well known Nyloc™ fasteners. Lower cylinder pin 15 is also coupled to one end of hydraulic cylinder 18. A pair of lower bushings 17 are provided to facilitate solid and secure positioning when hydraulic cylinder 18 is static, while still permitting relative rotation between hydraulic cylinder 18 and each link arm 12 when hydraulic cylinder 18 is activated. The top end of hydraulic cylinder 18 distal to lower cylinder pin 15 is coupled to upper cylinder pin 14. A pair of shim washers 19 are preferably provided that, like lower bushings 17, serve to keep all parts properly positioned longitudinally along the pin, in this case along upper cylinder pin 14.

A pair of hydraulic fittings 27 are coupled from a suitable hydraulic pump and valving arrangement to hydraulic cylinder 18. The use of two lines is preferred, allowing hydraulic cylinder 18 to be a double-acting cylinder, meaning it may be driven under power in either direction.

In the retracted or inoperative position illustrated in FIGS. 1-4, 6, and 7, hydraulic cylinder 18 is in a fully retracted position, which in turn pulls lower cylinder pin 15 most nearly to upper cylinder pin 14. In turn, this causes link pins 16 to move to their most distal position, likewise fully opening upper link arms 11. In this retracted or inoperative position, preferred embodiment pipe grabber 1 is merely a short extension to a pipe handler boom, otherwise not interfering in any way with the operation thereof. Because upper link arms 11 are fully retracted below the surface of trough extension 29 defined by first and second ridges 37, 38 and trough depression 39, and are also retained within the side walls 33-36 of pipe grabber box 13 and therefore within the sides of the pipe handler boom, there is no undesirable interference or extension beyond that which would otherwise be found in the pipe handler other than the slight lengthening, and the nominal extension of hydraulic cylinder 18 and lower link arms 12 below trough extension 29. Consequently, the handling of a pipe will proceed as it would have without preferred embodiment pipe grabber 1, and without any added risk or potential interference between the grabber and either the pipe or other machinery when the grabber is inactive.

When hydraulic cylinder 18 is extended, by the forceful pumping of hydraulic fluid through one of the pair of hydraulic fittings 27, it will cause upper link arms 11 to pivot into the position illustrated in FIG. 5. In this position, upper link arms 11 pass through first and second perforations 40, 41 visible in FIG. 1 and close in the manner of jaws, capturing a pipe 30 between upper link arms 11 and trough extension 29. While in some instances a harder metal surface may be provided in the pipe contacting region of upper link arms 11, in preferred embodiment pipe grabber 1 a pair of elastomeric grips 21 are provided. These elastomeric grips 21, which may for exemplary and non-limiting purposes be comprised by a urethane composition, provide a quieter, softer, and non-damaging engagement with pipe 30, while simultaneously increasing the holding power and contact surface area owing to the intrinsic deformation about the pipe circumference. In one embodiment, upper link arms 11 are designed to wrap sufficiently about pipe 30 that even in the unlikely event of a failure of one or both of the elastomeric grips 21, pipe 30 will still remain captured between the link arms and trough.

In accord with the preferred embodiment, to best facilitate control of the flow of hydraulic fluid to and from hydraulic cylinder 18 the valving is integrated into the pipe flipper control provided in the aforementioned commonly owned U.S. Pat. Nos. 9,388,647 and 9,845,646 incorporated by reference herein above. When the boom arm is down, such as might for exemplary and non-limiting purpose be detected by a mechanical, optical, magnetic or other proximity switch, the flipper control is configured in a first position to pump hydraulic fluid to the flippers, to thereby flip a pipe out of the trough. However, when the boom arm is lifted from the most lowered position and the flipper control is triggered to that same first position, a valve is actuated that instead directs the pumped hydraulic fluid to hydraulic cylinder 18 to thereby extend hydraulic cylinder 18 and capture pipe 30 therein, as illustrated in FIG. 5.

In the preferred embodiment, the flipper control is also provided with a second trigger position. When the boom is down and the flipper control is in the second trigger position, the flipper will be retracted, allowing another pipe to be placed within the trough. When the boom is lifted and the flipper control is set to the second trigger position, hydraulic cylinder 18 will be retracted, which in turn draws upper link arms 11 and elastomeric grips 21 into pipe grabber box 13, moving the grabber entirely out of the way of any pipe handling that may be required, and thereby also out of harm's way, thereby helping to ensure the safety of the pipe, other machinery, and personnel adjacent to the pipe handler.

While hydraulic cylinder 18 is most preferred, in alternative embodiments pneumatic, electric, and other apparatus will be used to provide motive force. Nevertheless, most pipe handlers include a hydraulic pump that can be used to drive hydraulic cylinder 18, and hydraulic cylinders incorporate a number of other benefits not found in alternative apparatus.

While the foregoing details what is felt to be the preferred embodiment of the invention, no material limitations to the scope of the claimed invention are intended. Further, features and design alternatives that would be obvious to one of ordinary skill in the art are considered to be incorporated herein. The scope of the invention is set forth and particularly described in the claims herein below.

We claim:

1. In combination, a pipe handler and pipe grabber, the pipe handler having a boom with a pipe supporting trough, the pipe grabber comprising:

a pipe grabber housing affixed adjacent to a longitudinal end of said pipe handler boom, said pipe grabber housing having a pipe retaining trough that is axially aligned with and terminates said pipe supporting trough and said pipe grabber housing having side walls extending from said pipe retaining trough;

an upper cylinder pin;

a lower cylinder pin;

a pair of upper link arms pivotal about said upper cylinder pin;

a pair of lower link arms pivotal about said lower cylinder pin;

a pair of link pins coupling individual ones of said pair of upper link arms to individual ones of said pair of lower link arms; and a hydraulic cylinder affixed between said upper cylinder pin and said lower cylinder pin;

said pipe grabber configured to capture a pipe within said pipe retaining trough when said hydraulic cylinder is extended; and said upper link arms configured to retract within said pipe grabber housing when said hydraulic cylinder is retracted;

wherein said pipe retaining trough has a depression running longitudinally between first and second ridges, a first perforation passing through said first ridge, and a second perforation passing through said second ridge;

a first one of said pair of upper link arms pivotal between a first active position passing through said first perforation and a second retracted position not passing through said first perforation; and a second one of said pair of upper link arms pivotal between a first active position passing through said second perforation and a second retracted position not passing through said second perforation.

2. The combination pipe handler and pipe grabber of claim 1, wherein said hydraulic cylinder is configured to pivot said pair of upper link arms distal to said upper cylinder pin closer together when said cylinder is extended.

3. The combination pipe handler and pipe grabber of claim 1, wherein said pipe grabber housing further comprises a pair of L-shaped support hooks protruding from a first one of said pipe grabber housing side walls.

4. The combination pipe handler and pipe grabber of claim 1, wherein said pipe grabber housing side walls further comprise at least one fastener hole configured to receive a fastener and thereby secure said pipe grabber housing to said pipe handler.

5. A pipe grabber, comprising:

an upper cylinder pin;

a lower cylinder pin;

a pair of upper link arms pivotal about said upper cylinder pin;

a pair of lower link arms pivotal about said lower cylinder pin;

a pair of link pins coupling individual ones of said pair of upper link arms to individual ones of said pair of lower link arms;

a cylinder affixed between said upper cylinder pin and said lower cylinder pin and operative to pivot said pair of upper link arms distal to said upper cylinder pin closer together when said cylinder is extended; and a pipe grabber housing having a pipe retaining trough and side walls extending from said pipe retaining trough.

6. The pipe grabber of claim 5, wherein said cylinder further comprises a hydraulic cylinder.

7. The pipe grabber of claim 5, wherein said pipe grabber is configured to capture a pipe within said pipe supporting trough when said hydraulic cylinder is extended.

8. The pipe grabber of claim 7, wherein said upper link arms are configured to retract within said pipe grabber housing when said hydraulic cylinder is retracted.

9. The pipe grabber of claim 5, wherein said pipe grabber housing further comprises a pair of L-shaped support hooks protruding from a first one of said pipe grabber housing side walls.

10. The pipe grabber of claim 9, wherein said pipe grabber housing side walls further comprise at least one fastener hole configured to receive a fastener and thereby secure said pipe grabber housing to said pipe handler.

11. A pipe grabber, comprising:

a pipe retaining trough having a depression running longitudinally between first and second ridges;

a first perforation passing through said first ridge;

a second perforation passing through said second ridge;

a first pivotal jaw pivotal between a first active position passing through said first perforation and a second retracted position not passing through said first perforation;

a second pivotal jaw pivotal between a first active position passing through said second perforation and a second retracted position not passing through said second perforation;

said first and second pivotal jaws configured to capture a pipe within said pipe retaining trough when each are in said first active position; and said first and second pivotal jaws configured to retract from said pipe retaining trough when each are in said second retracted position.

12. The pipe grabber of claim 11, further comprising a pipe grabber housing supporting said pipe retaining trough and defining side walls extending from said pipe retaining trough.

13. The pipe grabber of claim 12, wherein said pipe grabber is configured to capture a pipe within said pipe supporting trough when said first and second pivotal jaws are each in said first active position.

14. The pipe grabber of claim 13, wherein said first and second pivotal jaws are configured to retract within said pipe grabber housing when they are each in said second retracted position.

15. The pipe grabber of claim 12, wherein said pipe grabber housing further comprises a pair of L-shaped support hooks protruding from a first one of said pipe grabber housing side walls.

16. The combination pipe handler and pipe grabber of claim 15, wherein said pipe grabber housing side walls further comprise at least one fastener hole configured to receive a fastener and thereby secure said pipe grabber housing to said pipe handler.

17. In combination, a pipe handler and pipe grabber, the pipe handler having a boom with a pipe supporting trough, the pipe grabber comprising:

a pipe grabber housing affixed adjacent to a longitudinal end of said pipe handler boom, said pipe grabber housing having a pipe retaining trough that is axially aligned with and terminates said pipe supporting trough and said pipe grabber housing having side walls extending from said pipe retaining trough;

an upper cylinder pin;

a lower cylinder pin;

a pair of upper link arms pivotal about said upper cylinder pin;

a pair of lower link arms pivotal about said lower cylinder pin;

a pair of link pins coupling individual ones of said pair of upper link arms to individual ones of said pair of lower link arms; and a hydraulic cylinder affixed between said upper cylinder pin and said lower cylinder pin;

said pipe grabber configured to capture a pipe within said pipe retaining trough when said hydraulic cylinder is extended; and said upper link arms configured to retract within said pipe grabber housing when said hydraulic cylinder is retracted;

wherein said pipe grabber housing further comprises a pair of L-shaped support hooks protruding from a first one of said pipe grabber housing side walls.

* * * * *